United States Patent [19]

Poelma et al.

[11] 4,019,770

[45] Apr. 26, 1977

[54] HOISTING HOOK ASSEMBLY AND METHOD FOR HOISTING A LOAD

[75] Inventors: Cornelis Frederikus Poelma, Nuenen; Alexandre Horowitz, Eindhoven; Petrus Joseph Marie Verschure, Amsterdam, all of Netherlands

[73] Assignee: Varitrac A.G., Zug, Switzerland

[22] Filed: Jan. 27, 1976

[21] Appl. No.: 652,888

[30] Foreign Application Priority Data

Feb. 3, 1975 Netherlands ..... 7501270

[52] U.S. Cl. ..... 294/78 R; 294/82 R

[51] Int. Cl.[2] ..... B66C 1/14

[58] Field of Search ..... 294/67 E, 74, 75, 78 R, 294/78 A, 82 R, 82 AH, 83 R, 86 LS, 89; 24/230.5 AD, 230.5 LH, 230.5 CR, 230.5 CS, 230.5 SS, 230.5 T; 212/82, 85; 254/135 CE

[56] References Cited

UNITED STATES PATENTS

| | | | |
|---|---|---|---|
| 923,980 | 6/1909 | Lucas | 294/78 R |
| 1,725,902 | 8/1929 | Driscoll | 294/82 R |
| 1,860,121 | 5/1932 | Trout | 294/82 R |
| 2,043,460 | 6/1936 | Young | 294/78 R |
| 2,356,146 | 8/1944 | Caldwell | 294/74 |
| 2,414,092 | 1/1947 | Charwinsky | 294/82 R X |
| 2,552,758 | 5/1951 | Andersen | 294/82 R |
| 3,351,372 | 11/1967 | Marks et al. | 294/82 R X |

FOREIGN PATENTS OR APPLICATIONS

| | | | |
|---|---|---|---|
| 50,894 | 5/1932 | Norway | 294/74 |
| 279,924 | 1/1971 | U.S.S.R. | 294/74 |

*Primary Examiner*—Johnny D. Cherry

[57] ABSTRACT

A hoisting hook for at least four ropes comprising a block, a shaft rotatably supported in said block and a plurality of anchor-like devices rotatably supported in said shaft, so that sufficient degrees of freedom are created for the ropes to divide the hoisting load equally over the ropes.

9 Claims, 8 Drawing Figures

HOISTING HOOK ASSEMBLY AND METHOD FOR HOISTING A LOAD

BACKGROUND OF THE INVENTION

The invention relates to a hoisting hook assembly comprising a block with a hoisting element which consists of a shaft with attaching parts for the load ropes, which shaft is capable of rotation about a vertical axis and is supported in the block. Such an object is known in several variations and is used for hoisting large and medium large objects.

Very heavy and large-sized loads such as drilling platforms or their parts have as a rule a rectangular form. It is then usual to work with four load ropes, which ropes are fastened near the four angular points. Sometimes eight load ropes with attaching parts are used on the two long sides. Each rope ends in a loop or sling, and in the case of four ropes being used, around each of the four hooks of the hoisting element one of the slings is tied.

It is evident that the distribution of the load over the four load ropes depends entirely on the correct lengths of the four ropes. If the four taut ropes do not meet in one point, the load will, theoretically, be carried by two diagonally opposite load ropes. The elastic elongation of the ropes provides a very limited adaptation, but the latter is unreliable and, moreover, cannot be truly verified. Therefore, it is possible that that two load ropes might substantially carry the whole load. The strength and hence also the thickness of the load ropes should therefore be chosen carefully, which in the case of the very heavy loads referred to above leads to great difficulties.

SUMMARY OF THE INVENTION

The invention refers to a hoisting hook assembly aiming at obtaining a good and reliable distribution of the load with four or more load ropes.

A further object of the invention relates to the possibility of checking visually the degree of inequality of the individual rope loads in a simple way. According to the invention the shaft of the hoisting element is provided with at least two anchor-like devices capable of swinging about a central axis lying in a plane which is perpendicular to the shaft, the free ends of the anchor-like devices forming attaching parts. These features permit an additional degree of freedom, enabling the load distribution aimed at to be realized, in consequence of which it will as a rule suffice to reduce the dimensions of the load ropes to 1.2 times the nominal load calculated instead of twice, as is the case with the four-arm hoisting hook.

The invention enables more than two anchor-like devices (for instance three) to be pivotally connected to the shaft of the hoisting element in the case of hoisting a triangular or hexagonal object. Since most loads are formed by rectangular objects, the hoisting hook assembly according to the invention is preferably so constructed that the shaft of the hoisting element is provided with a central carrying element to which two swinging anchor-like devices are connected by way of mutually parallel hinge pins.

The invention further refers to a method for hoisting a load with the help of more than three load ropes, using a hoisting hook assembly indicated above. According to this method when picking up the load, one checks the angular position of the shafts of the anchor-like devices with respect to the direction of the corresponding load ropes, and one does not proceed to hoisting before the included angles are approximately equal. Consequently, this affords a visual check, which can further be facilitated if in the hoisting hook assembly according to the invention a bar is fixed at the bottom of each swinging anchor-like device in line with its axis.

DETAILED DESCRIPTION

Figure 1:
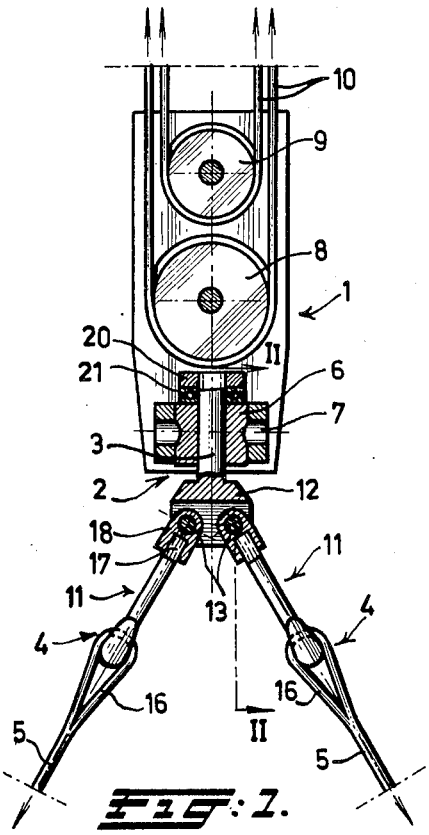
FIG. 1 is a side view, showing an embodiment with two swinging anchor-like devices, each with two hooks that can receive a loop or sling.
Figure 3:
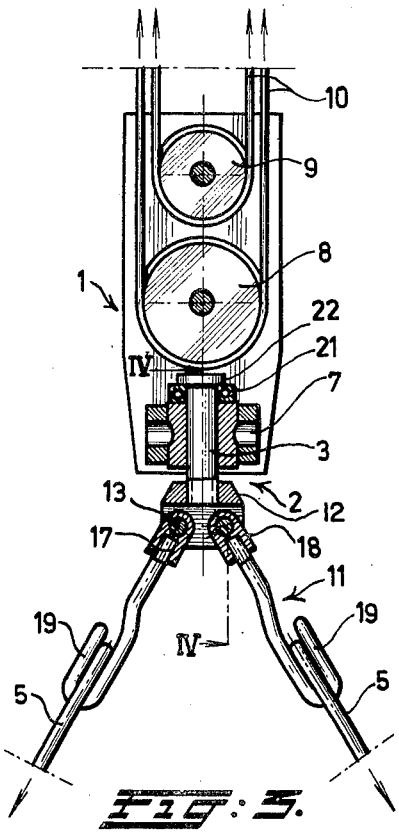
FIG. 3 is a view, similar to that of FIG. 1, of an embodiment comprising swinging anchor-like devices which receive the middle part of a continuous load rope.

As shown in FIGS. 1 and 3, the hoisting hook assembly consists of a block 1 provided with a hoisting element 2 made up of a shaft 3 and attaching parts 4, for the load ropes 5. Shaft 3 is in the usual manner rotatable round a vertical axis supported in block 1. Further, the shaft is capable of turning slightly around a horizontal axis owing to the shaft being mounted in hinged piece 6 provided with two lateral pins 7. Block 1 is furthermore provided with two rope pulleys 8 and 9 accommodating the hoisting cable 10. Thus far the hoisting hook assembly largely corresponds to the prior art situation.

Whereas in a well-known hoisting hook assembly the attaching parts 4 for the ropes 5 are permanently fixed to shaft 3 of the hoisting element 2 and form one whole with it, the shaft of the hoisting element according to the invention is provided with at least two anchor-like devices 11 that are capable of swinging around a center line lying in a plane perpendicular to shaft 3. The free ends of these devices form the attaching parts 4 for the load ropes 5. To this end, shaft 3 of the hoisting element 2 is provided with a central carrying element 12 to which the two swinging devices 11 are connected by means of two interparallel hinged shafts 13.

Figure 2:
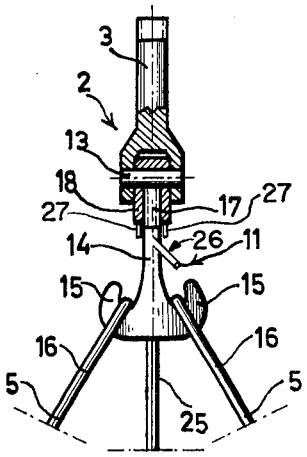
FIG. 2 is partially a view and partially the cross-section of the hoisting element in FIG. 1 according to the line II—II in that figure.

In the embodiment according to FIGS. 1 and 2 each anchor-like device 11 consists of a shaft 14 having two hooks 15 for the sling 16 of a load rope 5. Each device 11 is rotatable round the centre line of its shaft 14. To this end, the shaft 14 of each device 11 is fixed to a head 18 by means of screw thread 17, the head 18 being hinged to hoisting element 2. Between the shaft 14 and the head 18 means of limiting to less than 90° the rotation of each shaft round its center line are present. Such means may, for instance, consist of a lateral pin-shaped projection 26 of the shaft 14, which projection may operate together with two stops 27 on the head 18.

Figure 4:
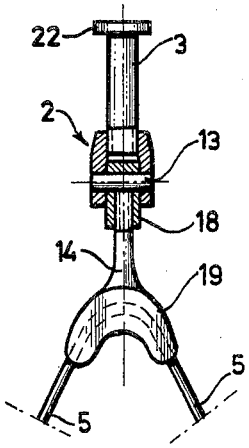
FIG. 4 is partially a view and partially the cross-section of the hoisting element in FIG. 3 according to the line III–IV in that figure.

There are a few remarkable points of difference between the hoisting hook assembly according to FIGS. 1 and 2 on the one hand and the embodiment according to FIGS. 3 and 4 on the other. One instance is that in the latter embodiment each attaching part 4 of a swinging anchor-like device 11 is designed as a doubly curved sliding saddle 19 in which a continuous load rope can slide. Another point of difference of the embodiment according to the FIGS. 3 and 4 with respect to the embodiment according to the FIGS. 1 and 2 is that in the latter design the shaft 3 of the hoisting element 2 is provided at its upper end, with screw thread in the usual manner, and onto this a nut 20 is screwed which rests on a rolling bearing 21. In the embodiment according to FIGS. 3 and 4 on the other hand, the central carrying element 12 is no longer whole with the shaft 3, but is an individual element provided with a hole with internal screw thread. The shaft 3 of the hoisting element 2 is designed as a bolt whose screw thread works together with the thread inside the carrying element. The head 22 of the bolt rests on the rolling bearing 21. This separation of the shaft 3 with respect to the central carrying element 12 enables the shaft to be designed as a bolt, which makes possible the manufacture from a high-alloy forged steel. This enables the diameter of the shaft 3 to be made smaller, which may produce a reduction of weight. As a consequence of this smaller thickness of the shaft 3 a smaller rolling bearing 21 can be applied, which brings about a saving of cost.

Figure 8:
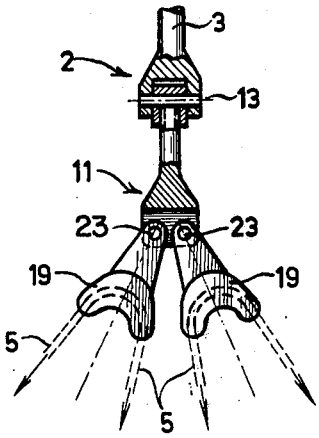
FIG. 8 is a variant of the hoisting element from FIG. 3, enabling hoisting processes with eight ropes by using four continuous ropes.

For hoisting with eight load ropes the embodiment according to the FIG. 8 is used. In it, each anchor-like device is provided with two hinged sliding saddles 19, the hinge pins 23 crossing the hinge shafts 13 perpendicularly. In each saddle 19 a continuous load rope is used. Each of the four "double" load ropes 5 then acts as attached individual ropes. The continuous rope 5 is capable of sliding through the saddle 19 as soon as the ratio of the forces in both parts of the rope exceeds the familiar ratio $e^{\mu\alpha}$, where $\mu$ represents the friction coefficient and $\alpha$ the bearing arc length in radicals. In actual practice this value will lie between 1.4 and 1.6. Consequently a large difference between the rope forces will automatically equalize in a great measure.

It is observed that the various types of swinging anchor-like devices 11 maybe screwed into the heads 18 so that the anchor like devices may be combined as desired. Thus a swinging anchor-like device with hooks may be used (FIG. 2) in combination with a swinging device, with sliding saddle (FIG. 4). Further it may be remarked that with reference to the system of forces to be discussed later with the help of FIGS. 5–7, the hinge pins 23 from the embodiment according to FIG. 8 are to be considered equivalent to the part of each sling 16 of FIG. 2, resting on the acting surface of the hook 15.

Figure 5:
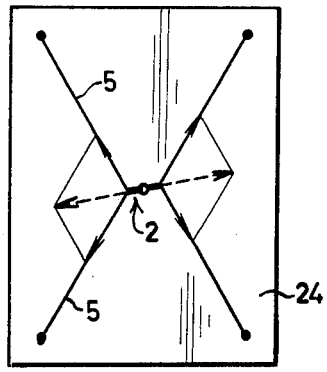
FIGS. 5 and 6 represent diagrammatically the top view and the side view of the arrangement of the load ropes and the forces involved.
Figure 6:
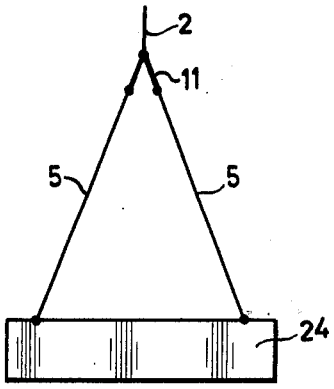

The operation of the hoisting hook assembly according to the invention is represented idealized in the FIGS. 5 and 6. In these Figures it is assumed that the center lines of two ropes attached to one anchor-like device intersect in the axis of the shaft of the device. In FIG. 5 the right hand ropes are exactly equal in length the left-hand ones differing a little in length. The hoisting hook assembly now rotates about its vertical axis until the resultant of the load-rope forces passes through the axis of the central carrying element 12. The ratio of the rope forces is now visible from the direction of the shaft 14 with respect to the load ropes 5. This is evident from the parallelogram of forces in FIG. 5. If there is a sliding saddle 19 instead of a double hook 15, then the continuous rope 5 will continue to slide until the ratio of forces equals $e^{\mu\alpha}$.

Figure 7:
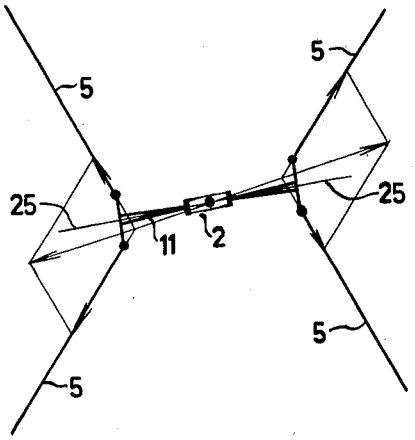
FIG. 7 shows on an enlarged scale the middle part of FIG. 5, a possible small deviation from the ideal situation being represented exaggeratedly.

FIG. 7 represents the situation of the middle part of FIG. 5 on an enlarged scale, and shows in an exaggerated manner the direction of the forces when the center lines of the ropes 5 meet outside the axis of the shaft 14. The resultant of the rope forces then exerts a relatively small bending moment on the shaft of the anchor-like device and the hinge shafts 13. In addition, the shafts 14 will rotate about their axes until the center lines of the ropes attached to an anchor-like device lie in one plane. Finally, the line of intersection of the two rope planes passes through the point of intersection of the center lines of the two shafts 14. From a comparison between FIGS. 5 and 7 it appears that the actual situation (represented in FIG. 7 exaggeratedly) of the distribution of forces can be somewhat more unfavorable than the idealized situation of FIG. 5. It is noticed that in the situation of FIG. 5 the rotatability of the shafts 14 of the swinging anchor-like devices 11 with respect to the heads 18 is not necessary. Consequently, in cases in which the center lines of the ropes meet in the center lines of the shafts 14, this rotatability can be dispensed with.

In the FIGS. 5 and 6 the load is represented as a rectangular element 24. Further, in FIG. 7 a rod 25 is also shown which is also shown in FIG. 2. The center line of this rod is a continuation of the center line of the shaft 14 of the swinging anchor-like device 11. The presence of this rod facilitates the visual verification of the measure of inequality of the individual rope loads. It should be remembered that in the case of hoisting very heavy loads such as drilling platforms and the like, cranes with very large dimensions are concerned, in consequence of which the hoisting hook assembly may be situated at a considerable distance of the verifying person. The presence of the rod 25 now makes it possible, in the case of an unfavorable ratio of the rope forces, to take action in good time and perform the required correction of the length of the rope.

An important practical advantage of the invention is that the hoisting hook assembly can be mounted in a simple way in any existing conventional hoisting block. This makes possible a replacement of the conventional hoisting hook by the hoisting hook assembly according to the invention with comparatively little loss of time at little cost.

What we claim is:

1. Hoisting hook assembly for hoisting a load by a plurality of load ropes comprising a block, a hoisting element on said block comprising a shaft, said shaft being rotatable around its vertical axis and supported in said block, said shaft further comprising a plurality of means for attaching the load ropes to the hoisting hook assembly, each of said means being rotatably attached to said shaft and capable of swinging about a center line situated in a plane perpendicular to said shaft.

2. Hoisting hook assembly according to claim 1 wherein said means comprises a shaft rotatable around its own axis.

3. Hoisting hook assembly according to claim 2 further comprising means for limiting to less than 90° the rotation of each shaft around its center line.

4. Hoisting hook assembly according to claim 1, in which the shaft of the hoisting element comprises a central carrying element, two swinging anchor-like devices, and interparallel hinge shafts to connect said swinging anchor-like devices to said central carrying element.

5. Hoisting hook assembly according to claim 4, in which each anchor-like device comprises two hooks adapted to receive the sling of the load rope.

6. Hoisting hook assembly according to claim 5, in which at the bottom of each swinging anchor-like device a rod is fastened with the center line of said rod being a continuation of the axis of said swinging anchor-like device.

7. Hoisting hook assembly according to claim 4, in which each anchor-like device comprises a doubly curved sliding saddle adapted for attachment of the load ropes.

8. Hoisting hook assembly according to claim 7, wherein each anchor-like device comprises two hinged sliding saddles.

9. Method for the hoisting of a load with the help of more than three ropes by use of a hoisting hook assembly comprising picking up the load by use of a hoisting hook assembly for hoisting a load by a plurality of load ropes comprising a shaft, said shaft being rotatable around its vertical axis and supported in a block, said shaft further comprising a plurality of means for attaching the load ropes to the hoisting hook assembly each of said means rotatably attached to said shaft and capable of swinging about a center line situated in a plane perpendicular to said shaft, wherein there are a plurality of said means for attaching said load ropes and each comprises an anchor-like device with a shaft, checking the angular position of the shafts of the anchor-like devices in respect of the direction of the corresponding load ropes, and performing the hoisting of the load only after the included angles are substantially equal.

* * * * *